US006997008B2

(12) United States Patent
Lee et al.

(10) Patent No.: US 6,997,008 B2
(45) Date of Patent: Feb. 14, 2006

(54) DEFROST WATER DRAINING UNIT FOR A REFRIGERATOR

(75) Inventors: Jong-Dal Lee, Suwon (KR); Gi-Joong Jeong, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/679,690

(22) Filed: Oct. 7, 2003

(65) Prior Publication Data

US 2004/0182100 A1 Sep. 23, 2004

(30) Foreign Application Priority Data

Mar. 22, 2003 (KR) ..... 10-2003-0017992

(51) Int. Cl.
*F25D 21/14* (2006.01)

(52) U.S. Cl. ..... 62/285; 62/288; 62/291

(58) Field of Classification Search ..... 62/285, 62/288, 291, 286, 259.1, 298, 150, 272
See application file for complete search history.

(56) References Cited

U.S. PATENT DOCUMENTS 5,499,514 A * 3/1996 Ho ..... 62/291
5,729,997 A 3/1998 Witsoe ..... 62/407
5,881,566 A * 3/1999 Shacklock et al. ..... 62/277
5,966,958 A * 10/1999 Maynard ..... 62/277

* cited by examiner

*Primary Examiner*—Chen Wen Jiang
(74) *Attorney, Agent, or Firm*—Staas & Halsey LLP

(57) ABSTRACT

A refrigerator having a draining unit to drain defrost water, produced by both an evaporator and a refrigerant pipe, to an outside of a cabinet thereof. The refrigerator having a storage compartment defined in the cabinet, with an evaporator provided in the cabinet to supply cool air to the storage compartment. A first defrost water tray having a first drain port is positioned under the evaporator to drain the defrost water produced by the evaporator. A second defrost water tray is positioned under both the refrigerant pipe extending to the evaporator and the first drain port of the first defrost water tray, so as to guide a draining of the defrost water produced by the refrigerant pipe and the defrost water drained from the first drain port of the first defrost water tray. The second defrost water tray having a second drain port which is connected to a drain guide hose.

22 Claims, 4 Drawing Sheets

DEFROST WATER DRAINING UNIT FOR A REFRIGERATOR

CROSS-REFERENCE TO RELATED APPLICATIONS

This application claims the benefit of Korean Application No. 2003-17992, filed Mar. 22, 2003, in the Korean Intellectual Property Office, the disclosure of which is incorporated herein by reference.

BACKGROUND OF THE INVENTION

1. Field of the Invention

The present invention relates, in general, to refrigerators and, more particularly, to a refrigerator which has a draining unit to drain defrost water, produced by both an evaporator and a refrigerant pipe, to the outside of a cabinet.

2. Description of the Related Art

Generally, refrigerators are machines in which cool air is produced through a heat exchanging process performed by an evaporator. The cool air is then supplied to a storage compartment so as to keep a variety of food, stored in the storage compartment, cool, thereby preserving the freshness of the food for a desired period of time. During operation of a refrigerator, air with a high humidity circulates in a refrigerator cabinet, starting in the storage compartment, passing through the evaporator, and then returning to the storage compartment. During operation, the air with high humidity comes into repeated contact with the cold evaporator causing frost to gather on the surface of the evaporator. The layer of frost on the evaporator gradually thickens over time, so that eventually the frost may block an air-circulating path through which the circulating air passes. Therefore, in a conventional refrigerator, a defrosting heater is installed near the evaporator to periodically defrost the evaporator. In addition, a defrost water tray is usually installed under the evaporator to collect defrost water from the evaporator, and the collected defrost water then drains to the outside of the cabinet.

However, a conventional refrigerator is problematic in that the defrosting heater is installed around the evaporator and the defrost water tray is installed under the evaporator. As a result, it is not likely to effectively defrost a refrigerant pipe which extends from the condenser to the evaporator.

In addition, conventional refrigerators do not have defrost water trays under the refrigerant pipe from the condenser to the evaporator. Therefore, when the refrigerant pipe is defrosted, the defrost water from the refrigerant pipe may flow into the storage compartment.

SUMMARY OF THE INVENTION

Accordingly, one aspect of the present invention provides a refrigerator which is able to drain defrost water produced by a refrigerant pipe, extending from a condenser to an evaporator, together with defrost water produced by the evaporator, to the outside of the cabinet Additional aspects and advantages of the invention will be set forth in part in the description which follows and, in part, will be obvious from the description, or may be learned by practice of the invention.

The foregoing and/or other aspects of the present invention are achieved by providing a refrigerator, including: a cabinet defining a storage compartment therein; an evaporator located in the cabinet to supply cool air to the storage compartment; a first defrost water tray provided under the evaporator to drain defrost water produced by the evaporator, the first defrost water tray having a first drain port; and a second defrost water tray provided under both a refrigerant pipe extending to the evaporator and the first drain port of the first defrost water tray, so as to guide a draining of defrost water produced from the refrigerant pipe and the defrost water drained from the first drain port of the first defrost water tray, the second defrost water tray having a second drain port, which is connected to a drain guide hose.

In the refrigerator, the second defrost water tray is provided therein with a heater to defrost the refrigerant pipe, and a heat transfer plate to evenly transfer heat from the heater to an entire area of the second defrost water tray.

In addition, the evaporator is provided in an air-cooling chamber located at a rear portion of a top of the cabinet, and the refrigerant pipe extends from a machine room, located at a front portion of the top of the cabinet, to the evaporator while passing an upper portion of the storage compartment.

The foregoing and/or other aspects of the present invention can also be achieved by providing a refrigerator, including: a cabinet defining a storage compartment therein; an evaporator provided in the cabinet to supply cool air to the storage compartment; a first defrost water tray located under the evaporator to drain defrost water produced from the evaporator, the first defrost water tray having a drain port which is connected to a drain guide hose; and a second defrost water tray located under a refrigerant pipe extending to the evaporator, so as to guide defrost water produced from the refrigerant pipe to the first defrost water tray.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
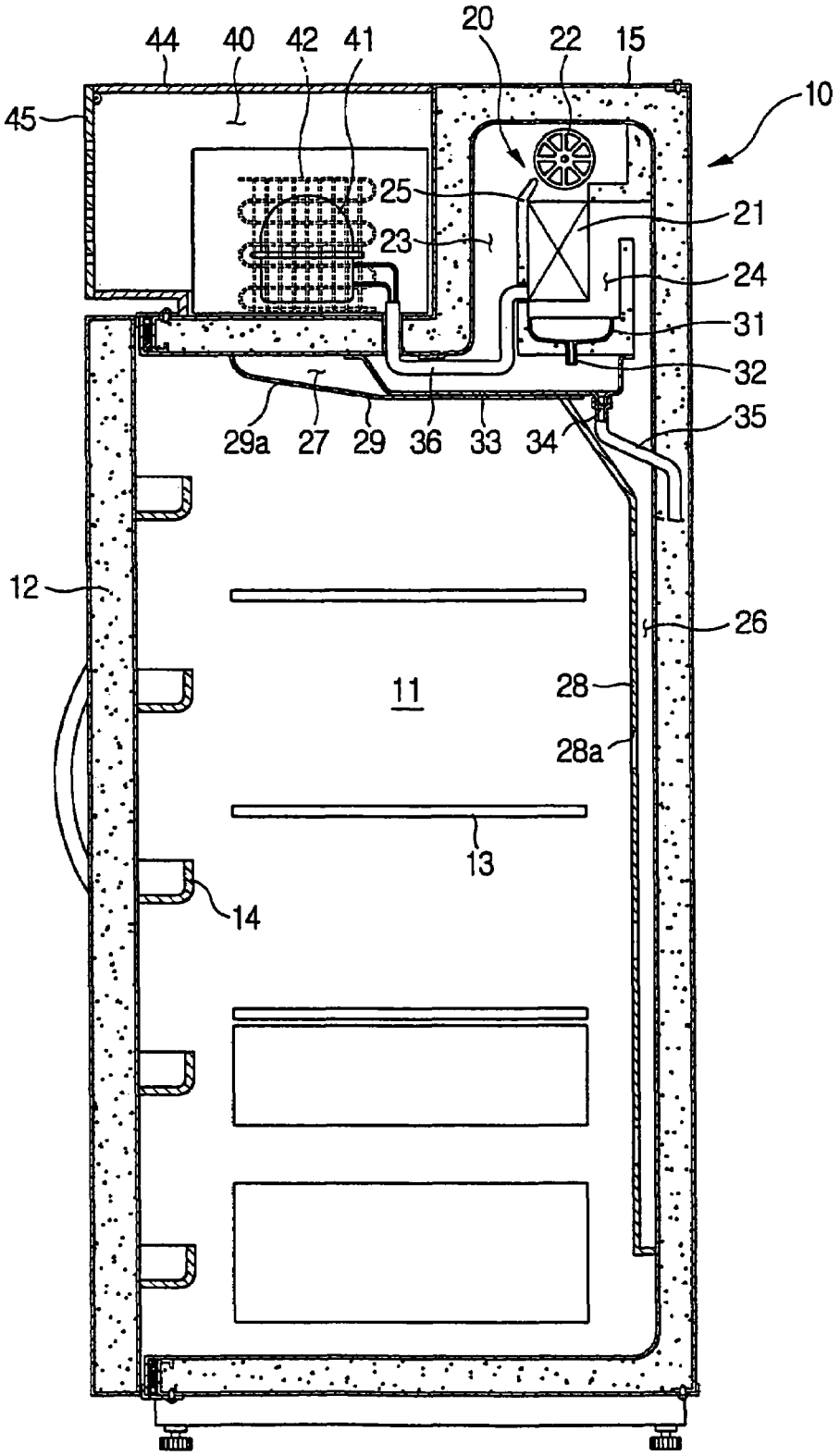
FIG. 1 is a side sectional view of a refrigerator, according to an embodiment of the present invention.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

FIG. 1 is a side sectional view of a refrigerator, according to an embodiment of the present invention. As shown in the drawing, the refrigerator has a cabinet 10, with a storage compartment 11 located in the cabinet 10. A door 12 is hinged to an open front of the storage compartment 11 to open or close the storage compartment 11. A plurality of racks 13 are installed in the storage compartment 11, and a plurality of door shelves 14 are provided on an inner surface of the door 12. The racks 13 and door shelves 14 allow a user to effectively store food in the refrigerator.

The rear portion of the cabinet 11 extends upward to form an upper projection 15. The upper projection 15 contains an air-cooling chamber 20 that houses an evaporator 21 and a cool air circulation fan 22. Due to the upper projection 15, the upper rear section of the storage compartment 11 is extended upward to form the air-cooling chamber 20. The air-cooling chamber 20 is horizontally and vertically (longitudinally) formed along the rear portion of the upper section of the storage compartment 11. The upper projection 15 is integrated with the cabinet 10, and is formed with a wall made of a thermal insulation material in the same manner as the cabinet 10 to thermally insulate the air-cooling chamber 20 from the atmosphere.

A machine room 40 is located on the top of the cabinet 10 at a position in front of the upper projection 15, and houses a compressor 41, a condenser 42, and a cooling fan (not shown). The machine room 40 is defined by a machine room casing 44 which is installed at the top of the cabinet 10. A cover member 45 is mounted at upper corners of the machine room casing 44 so as to cover or uncover an open front of the machine room casing 44.

An air path partition plate 25 is provided in the air-cooling chamber 20 so as to partition the interior of the air-cooling chamber 20 into a front space 23 and a rear space 24. The air path partition plate 25 is spaced apart from the upper surface of the air-cooling chamber 20 by a predetermined gap, thus forming a flow path through which the front and rear spaces 23 and 24 are connected. The evaporator 21 is installed in the rear space 24 to produce cool air. The cool air circulation fan 22 is installed above the evaporator 21. The cool air circulation fan 22 is a cross-flow fan which horizontally extends in the air-cooling chamber 20 so as to have a length almost equal to a length of the air-cooling chamber 20, and is positioned so as to be close to the upper edge of the air path partition plate 25.

An air suction path 26 is located at the rear portion of the storage compartment 11 to allow the air to flow from the storage compartment 11 into the rear space 24 and the evaporator 21, when the cool air circulation fan 22 is operated. An air exhaust path 27 is provided at the upper portion of the storage compartment 11 so as to uniformly discharge the cool air from the air-cooling chamber 20 into the upper portion of the storage compartment 11. The air suction path 26 is formed by a panel-type air suction guide member 28 which is vertically installed along the rear surface of the storage compartment 11 while forming a vertical channel between the air suction guide member 28 and the rear surface of the storage compartment 11. A plurality of air suction ports 28*a* are formed in the air suction guide member 28. The air exhaust path 27 is formed by a panel-type air exhaust guide member 29 which is mounted to the upper surface of the storage compartment 11. The air exhaust guide member 29 is spaced apart from the upper surface of the storage compartment 11, and has a plurality of air exhaust ports 29*a* formed in the air exhaust guide member 29.

The above-described refrigerator of the present invention circulates air as follows. When the cool air circulation fan 22 located in the air-cooling chamber 20 is operated, air from the storage compartment 11 is drawn into the air suction path 26 through the air suction ports 28*a* of the air suction guide member 28, and flows to the air-cooling chamber 20. In the air-cooling chamber 20, the air passes through the evaporator 21, losing heat and becoming cool air. The cool air then passes through the front space 23 of the air-cooling chamber 20, and is discharged into the storage compartment 11 through the air exhaust path 27, due to the force of the cool air circulation fan 22.

Figure 2:
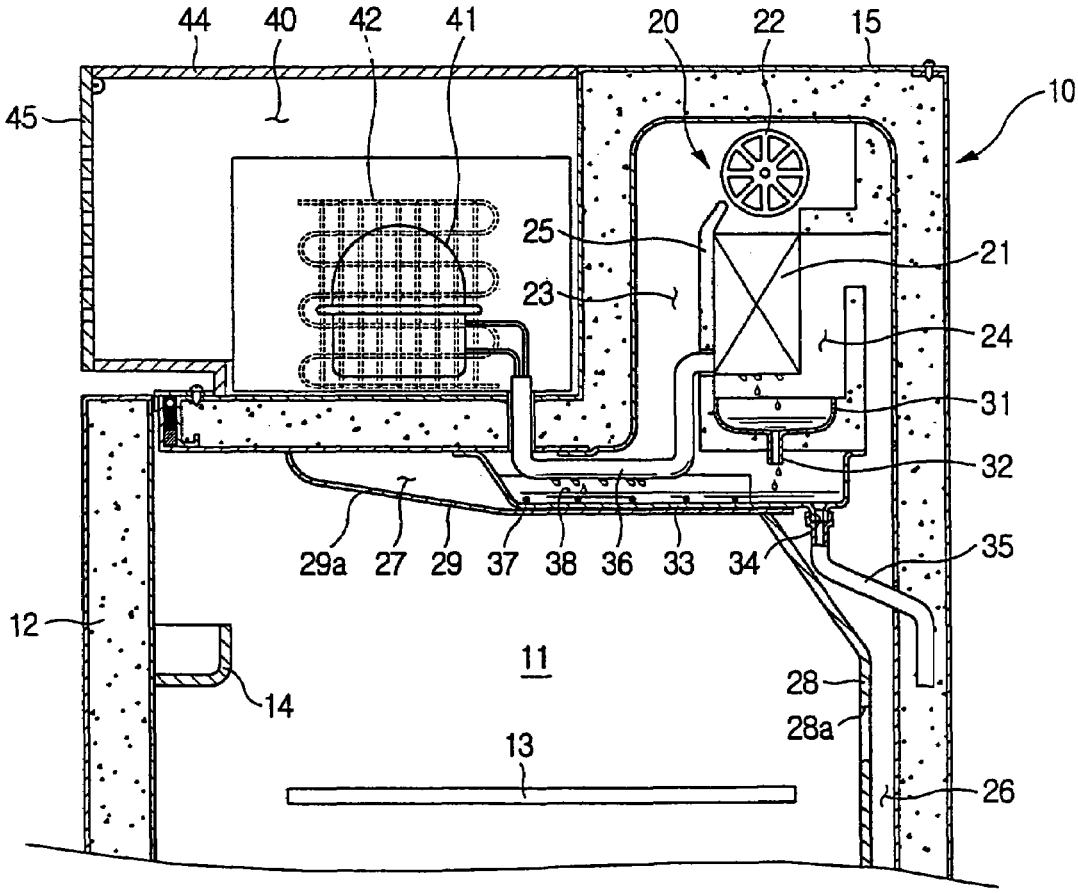
FIG. 2 is a side sectional view of an upper portion of the refrigerator of FIG. 1, which has a defrost water draining unit with first and second defrost water trays.
Figure 3:
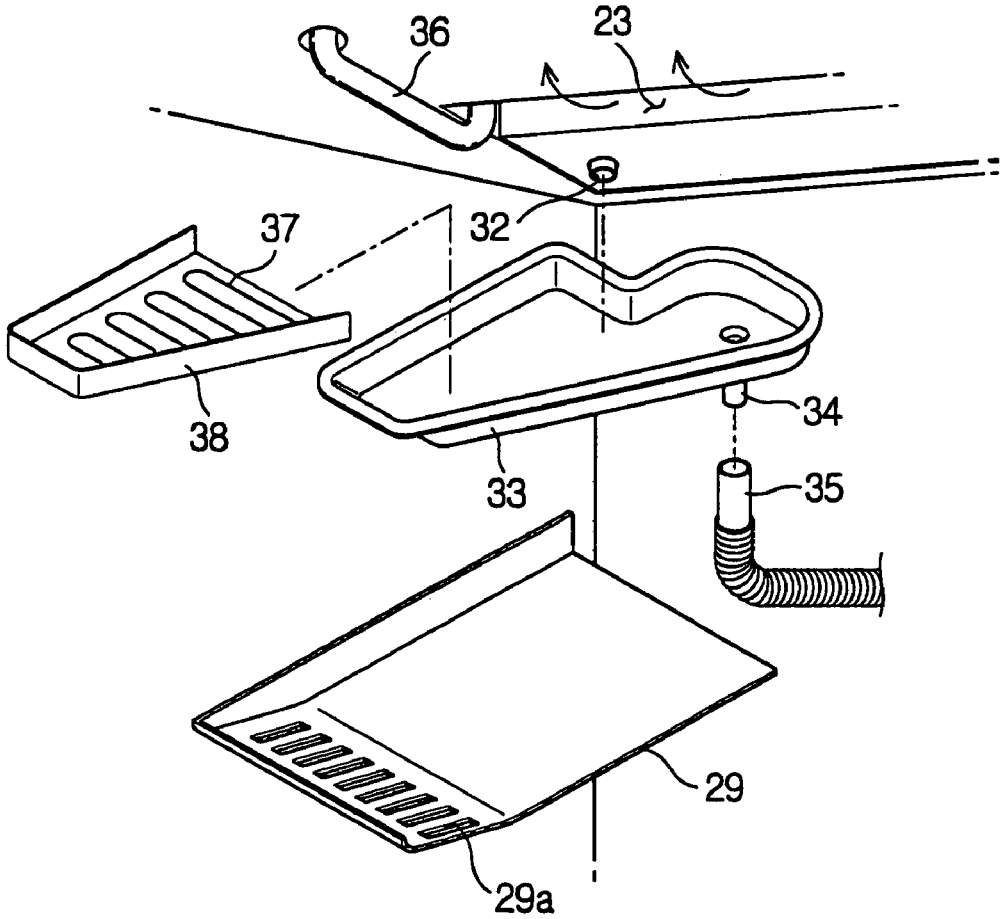
FIG. 3 is an exploded perspective view showing a construction of the second defrost water tray of FIG. 2.

As shown in FIGS. 2 and 3, the refrigerator of the present invention has a defrost water draining unit to drain defrost water from the refrigerant pipe 36, extending from the condenser 42 to the evaporator 21, together with defrost water produced from the evaporator, to the outside of the cabinet 10. According to the embodiment of FIGS. 2 and 3, the defrost water draining unit has a first defrost water tray 31 which is installed under the evaporator 21 to collect defrost water from the evaporator 21, when the evaporator 21 is defrosted. The first defrost water tray 31 has a first drain port 32 at the bottom thereof. The refrigerant pipe 36 extends from the condenser 42 of the machine room 40 to the evaporator 21 of the air-cooling chamber 20 while passing through the upper portion of the storage compartment 11. A second defrost water tray 33 is installed under the refrigerant pipe 36 to collect and drain defrost water from the refrigerant pipe 36, when the refrigerant pipe 36 is defrosted. In the embodiment of FIGS. 2 and 3, the second defrost water tray 33 is configured and arranged such that the second defrost water tray 33 covers both the lower part of the refrigerant pipe 36 and the lower end of the first drain port 32 of the first defrost water tray 31. The second defrost water tray 33 thus collects and drains the defrost water from the refrigerant pipe 36 and from the first drain port 32. The second defrost water tray 33 includes a second drain port 34 which is connected to a drain guide hose 35.

In another embodiment of the present invention, the defrost water draining unit drains the defrost water produced by the refrigerant pipe 36 extending from the condenser 41 to the evaporator 21, together with the defrost water produced by the evaporator 21, to the outside of the cabinet 10.

A heat transfer plate 38 having a defrosting heater 37 can be installed in the second defrost water tray 33, as shown in FIG. 3. The heat transfer plate 38 is made of a metal plate having a predetermined surface area, with the defrosting heater 37 arranged on the metal plate, so that heat generated from the defrosting heater 37 is evenly transferred to a desired area of the second defrost water tray 33 through the heat transfer plate 38. The refrigerant pipe 36 can thus be effectively defrosted. In additional embodiments of the present invention, the heat transfer plate 38 is made of materials other than metal.

Figure 4:
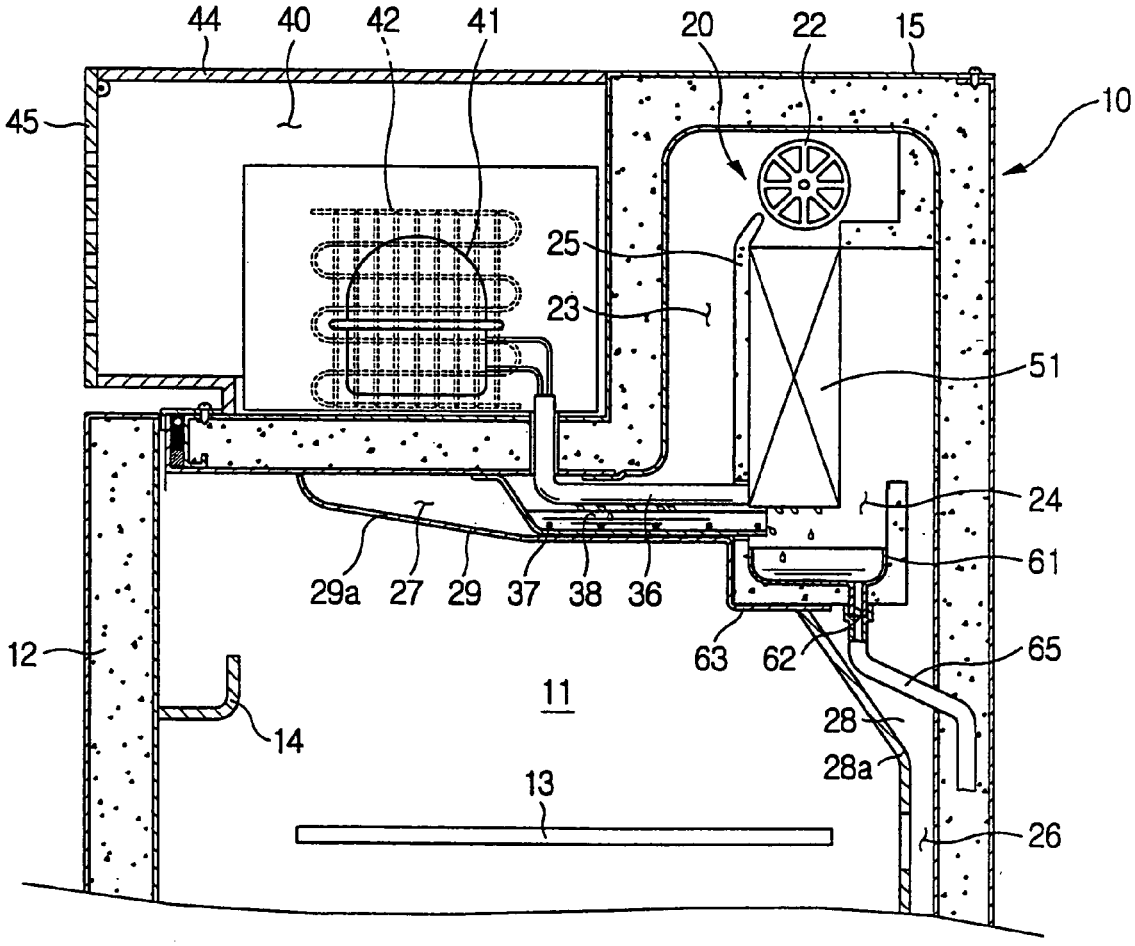
FIG. 4 is a side sectional view of an upper portion of a refrigerator, which has a defrost water draining unit according to another embodiment of the present invention.

FIG. 4 is a side sectional view of an upper portion of a refrigerator, having a defrost water draining unit according to another embodiment of the present invention. The defrost water draining unit of FIG. 4 is suitable for being used in a refrigerator which has a large capacity evaporator 51 in the air-cooling chamber 20. A first defrost water tray 61, having a drain port 62 at a bottom thereof, is installed under the evaporator 51 to collect and drain defrost water. A drain guide hose 65 is connected to the drain port 62 of the first defrost water tray 61. A second defrost water tray 63 is installed under the refrigerant pipe 36 to collect and drain defrost water from the refrigerant pipe 36. In the embodiment of FIG. 4, the second defrost water tray 63 is placed at a position higher than that of the first defrost water tray 61, so that the defrost water from the refrigerant pipe 36 is first collected in the second defrost water tray 63, and then flows from the second defrost water tray 63 into the first defrost water tray 51. The defrost water draining unit of FIG. 4 also has a heat transfer plate 38, which is provided with a defrosting heater 37 and is installed in the second defrost water tray 63 in the same manner as that described for the embodiment of FIGS. 2 and 3.

As is apparent from the above description, an embodiment of the present invention provides a refrigerator which has a second defrost water tray located under a refrigerant pipe extending from the condenser to the evaporator, in addition to a first defrost water tray located under the evaporator. In the refrigerator, defrost water produced by the refrigerant pipe is thus drained together with defrost water produced by the evaporator to the outside of the cabinet.

In addition, a heat transfer plate having a defrosting heater is installed in the second defrost water tray, so that heat generated from the defrosting heater is evenly transferred to the entire area of the second defrost water tray through the heat transfer plate. The defrosting of the refrigerant pipe is thus effectively performed.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a cabinet comprising a storage compartment;

an evaporator;

a refrigerant pipe connected to the evaporator;

a first defrost water tray, positioned so as to collect water formed on the evaporator, the first defrost water tray having a first drain port to drain water from the first defrost water tray;

a second defrost water tray, positioned so as to collect water formed on the refrigerant pipe, and water drained from the first defrost water tray through the first drain port, the second defrost water tray having a second drain port to drain water from the second defrost water tray; and a drain guide hose, connected to the second drain port, to drain water from the second drain port to an outside of the cabinet.

2. The refrigerator according to claim 1, wherein the second defrost water tray further comprises a heating element defrosting the refrigerant pipe, and a heat transfer plate distributing heat from the heating element throughout the second defrost water tray.

3. The refrigerator according to claim 1, wherein the evaporator is located in air-cooling chamber defined at a rear portion of a top of the cabinet, and the refrigerant pipe extends from a machine room, defined at a front portion of the top of the cabinet, to the evaporator while passing through an upper portion of the storage compartment.

4. The refrigerator according to claim 1, wherein the water formed on the evaporator and the water formed on the refrigerant pipe are the result of defrosting.

5. The refrigerator according to claim 1, wherein the cabinet further contains a heating element defrosting the refrigerant pipe.

6. The refrigerator according to claim 1, wherein the first defrost water tray is located under the evaporator.

7. The refrigerator according to claim 1, wherein the second defrost water tray is located under the refrigerant pipe.

8. The refrigerator according to claim 1, wherein the second defrost water tray is located under the refrigerant pipe and the first defrost water tray.

9. A refrigerator, comprising:

a cabinet defining a storage compartment therein;

an evaporator;

a refrigerant pipe connected to the evaporator;

a first defrost water tray positioned to collect water formed on the evaporator, the first defrost water tray having a first drain port to drain water from the first defrost water tray, and a drain guide hose to drain water from the first drain port to an outside of the cabinet; and a second defrost water tray positioned so as to collect water formed on the refrigerant pipe, the second defrost water tray having a second drain port to drain water from the second defrost water tray into the first defrost water tray.

10. The refrigerator according to claim 9, wherein the water formed on the evaporator and the water formed on the refrigerant pipe are the result of defrosting.

11. The refrigerator according to claim 9, wherein the second defrost water tray further comprises a heater defrosting the refrigerant pipe and a heat transfer plate to distribute heat from the heater throughout the second defrost water tray.

12. The refrigerator according to claim 9, wherein the first defrost water tray is located under the evaporator.

13. The refrigerator according to claim 9, wherein the second defrost water tray is located under the refrigerant pipe.

14. The refrigerator according to claim 9, wherein the first defrost water tray is located under the evaporator and the second defrost water tray.

15. The refrigerator according to claim 9, wherein the refrigerator further comprises a heating element defrosting the refrigerant pipe.

16. The refrigerator according to claim 9, wherein the evaporator is located in an air-cooling chamber defined at a rear portion of a top of the cabinet, and the refrigerant pipe extends from a machine room, defined at a front portion of the top of the cabinet, to the evaporator while passing through an upper portion of the storage compartment.

17. A refrigerator comprising:

a cabinet, containing a storage compartment;

a refrigerant pipe;

a defrost water tray positioned to collect water formed on the refrigerant pipe;

an evaporator connected to the refrigerant pipe; and a second defrost water tray positioned to collect water formed on the evaporator.

18. The refrigerator according to claim 17, wherein either the defrost water tray or the second defrost water tray is positioned so as to collect water drained from the other defrost water tray.

19. The refrigerator according to claim 18, further comprising:

a drain port; and a drain guide hose;

wherein the drain port is located in either the defrost water tray or the second defrost water tray, the drain port is attached to the drain guide hose, and the drain guide hose drains water to an outside of the refrigerator.

20. A refrigerator comprising:

an evaporator;

a refrigerant pipe connected to the evaporator;

a first defrost water tray, positioned to collect water formed by the evaporator; and a second defrost water tray, positioned to collect water formed on the refrigerant pipe;

wherein, one of the defrost water trays is positioned so as to receive water collected in the other tray.

21. The refrigerator according to claim 20, wherein the first defrost water tray is positioned so as to receive water from the second defrost water tray.

22. The refrigerator according to claim 20, wherein the second defrost water tray is positioned so as to receive water from the first defrost water tray.

* * * * *